US012006601B1

(12) United States Patent
Hines, Jr. et al.

(10) Patent No.: US 12,006,601 B1
(45) Date of Patent: Jun. 11, 2024

(54) LIGHTWEIGHT, FLAME RESISTANT FABRICS PROTECTIVE AGAINST ARC FLASH AND THERMAL PERFORMANCE

(71) Applicant: National Safety Apparel, Inc., Cleveland, OH (US)

(72) Inventors: Robert W. Hines, Jr., Columbus, GA (US); James Jonathan Bailey, Fortson, GA (US); Marty Edward Odum, Hamilton, GA (US); Toby James Bielenberg, Highland Park, IL (US)

(73) Assignee: National Safety Apparel, Inc., Cleveland, OH (US)

( * ) Notice: Subject to any disclaimer, the term of this patent is extended or adjusted under 35 U.S.C. 154(b) by 77 days.

(21) Appl. No.: 17/934,839

(22) Filed: Sep. 23, 2022

Related U.S. Application Data

(60) Provisional application No. 63/248,103, filed on Sep. 24, 2021.

(51) Int. Cl.

| | |
|---|---|
| ***D03D 15/00*** | (2021.01) |
| ***D03D 1/00*** | (2006.01) |
| ***D03D 13/00*** | (2006.01) |
| ***D03D 15/225*** | (2021.01) |
| ***D03D 15/283*** | (2021.01) |

(Continued)

(52) U.S. Cl.
CPC ..... *D03D 15/513* (2021.01); *D03D 1/0035* (2013.01); *D03D 13/004* (2013.01); *D03D 13/008* (2013.01); *D03D 15/225* (2021.01); *D03D 15/283* (2021.01); *D03D 15/47* (2021.01); *D03D 15/533* (2021.01); *D10B 2321/10* (2013.01); *D10B 2331/021* (2013.01); *D10B 2401/022* (2013.01); *D10B 2401/04* (2013.01); *D10B 2501/04* (2013.01)

(58) Field of Classification Search
CPC .. D03D 15/513; D03D 1/0035; D03D 13/004; D03D 13/008; D03D 15/225; D03D 15/283; D03D 15/47; D03D 15/533; D10B 2321/10; D10B 2331/021; D10B 2401/022; D10B 2401/04; D10B 2501/04
See application file for complete search history.

(56) References Cited

U.S. PATENT DOCUMENTS 8,732,863 B2 * 5/2014 Hines ..... C08L 33/20 2/81
8,973,164 B2 * 3/2015 Hines ..... D02G 3/047 2/81

(Continued)

*Primary Examiner* — Robert H Muromoto, Jr.
(74) *Attorney, Agent, or Firm* — BENESCH, FRIEDLANDER, COPLAN & ARONOFF LL

(57) ABSTRACT

A fabric includes flame-resistant Rayon fiber, about 10% by weight to about 20% by weight, based on an effective fabric blend; and oxidized polyacrylonitrile fiber, about 5% by weight to about 15% by weight, based on the effective fabric blend. The fabric includes para-aramid, about 5% by weight to about 15% by weight, based on the effective fabric blend; and nylon fiber, greater than about 0% by weight to about 15% by weight, based on the effective fabric blend. The fabric also includes anti-static fiber, less than 2% by weight, based on the effective fabric blend; and meta-aramid fiber, about 44% by weight to about 80% by weight, based on the effective fabric blend. The fabric has a basis weight of less than about 6.5 oz/yd$^2$ or 220.39 g/m$^2$.

9 Claims, 6 Drawing Sheets

(51) Int. Cl.

| | |
|---|---|
| ***D03D 15/47*** | (2021.01) |
| ***D03D 15/513*** | (2021.01) |
| ***D03D 15/533*** | (2021.01) |

(56) References Cited

U.S. PATENT DOCUMENTS

| | | | | |
|---|---|---|---|---|
| 9,745,674 | B2 | 8/2017 | Hines et al. | |
| 10,030,326 | B2 * | 7/2018 | Hines, Jr. | D02G 3/443 |
| 10,094,052 | B1 * | 10/2018 | Tsai | D02G 3/443 |
| 10,240,263 | B2 * | 3/2019 | Atkinson | D04H 1/70 |
| 11,261,546 | B2 * | 3/2022 | Atkinson | D01G 13/00 |
| 11,473,224 | B1 * | 10/2022 | Odum | D03D 15/283 |
| 2013/0042385 | A1 * | 2/2013 | Hines | A62B 17/003 428/221 |
| 2014/0187113 | A1 * | 7/2014 | Hines, Jr. | D04H 1/43835 428/221 |
| 2014/0223650 | A1 * | 8/2014 | Hines | A41D 31/08 428/221 |
| 2017/0198423 | A1 * | 7/2017 | Hines, Jr. | D02G 3/047 |
| 2019/0249342 | A1 | 8/2019 | Dash et al. | |

* cited by examiner

400

LIGHTWEIGHT, FLAME RESISTANT FABRICS PROTECTIVE AGAINST ARC FLASH AND THERMAL PERFORMANCE

CROSS-REFERENCE TO RELATED APPLICATIONS

This application claims priority to U.S. Provisional Application No. 63/248,103, filed on Sep. 24, 2021, entitled Lightweight, Flame Resistant Fabrics Protective Against Arc Flash and Thermal Performance, which is incorporated herein in its entirety.

TECHNICAL FIELD

The present disclosure generally relates to performance fabrics. More particularly, the disclosure relates to lightweight fabrics with a balance of thermal, durability, and comfort properties and to the garments and articles made from the fabrics.

BACKGROUND

Clothing against arc flash and thermal hazards that include performance fabric features like moisture wicking and fast drying are available on the market. For example, lightweight performance fabrics are available on the market and may offer level 2 arc flash protection and meet the requirements of NFPA 2112.

SUMMARY

In one embodiment, a fabric includes flame-resistant Rayon fiber, about 10% by weight to about 20% by weight, based on an effective fabric blend; and oxidized polyacrylonitrile fiber, about 5% by weight to about 15% by weight, based on the effective fabric blend. The fabric includes para-aramid, about 5% by weight to about 15% by weight, based on the effective fabric blend; and nylon fiber, greater than about 0% by weight to about 15% by weight, based on the effective fabric blend. The fabric also includes anti-static fiber, less than 2% by weight, based on the effective fabric blend; and meta-aramid fiber, about 44% by weight to about 80% by weight, based on the effective fabric blend. The fabric has a basis weight of less than about 6.5 oz/yd$^2$ or 220.39 g/m$^2$.

DETAILED DESCRIPTION

Figure 1:
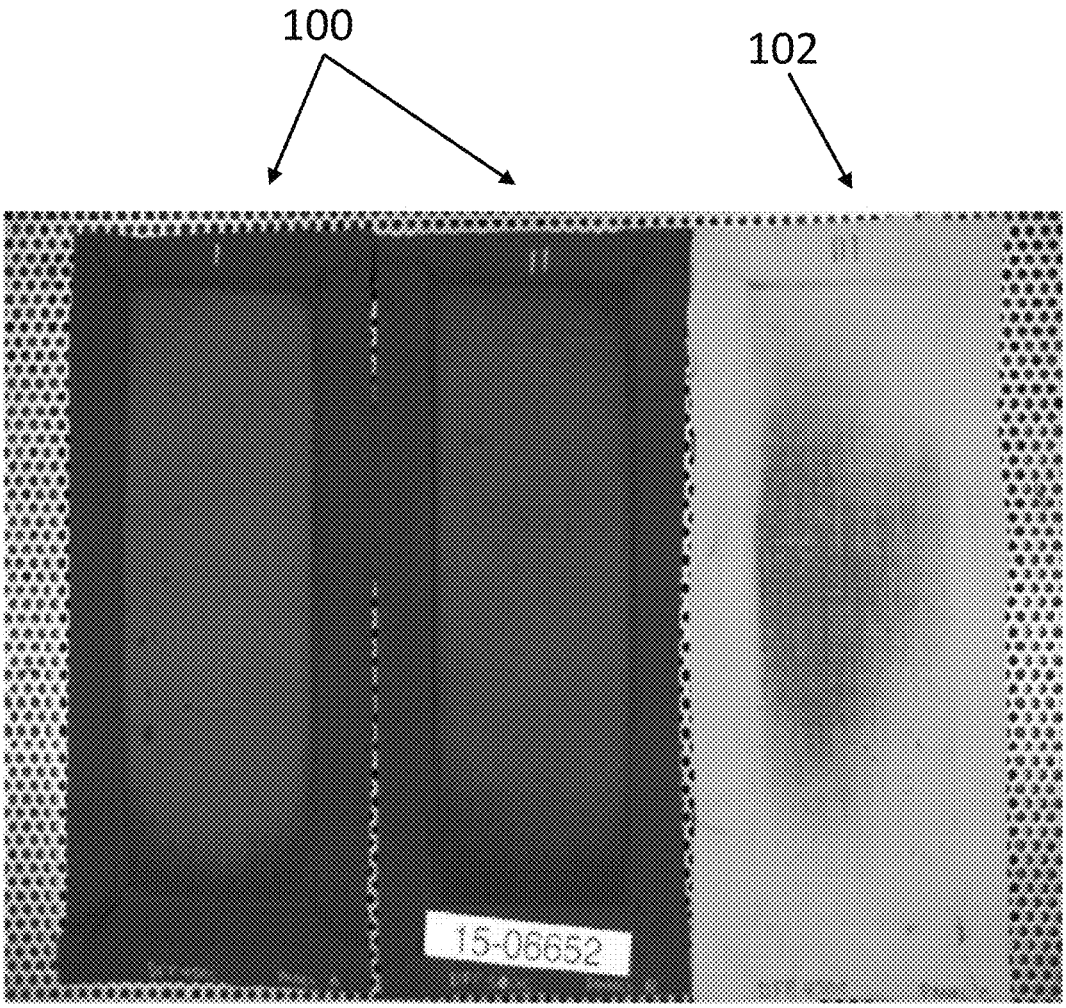
FIG. 1 shows fabric panels after arc exposure.

Clothing against arc flash and thermal hazards that include performance fabric features like moisture wicking and fast drying are available on the market. For example, lightweight performance fabrics that offer level 2 arc flash protection (Arc rating of at least 8 cal/cm$^2$) and also meet the requirements of NFPA 2112 are available on the market. Some of these available fabrics on the market are manufactured and tested in darker colors, e.g., navy blue. However, it is challenging to have a high performance, lightweight fabric that is in lighter color, e.g., khaki. Subsequent testing of some lighter shade fabrics including khaki shows that the arc protection may not meet the 8-calorie arc flash requirement. The present disclosure overcomes this limitation by providing a lighter shade fabric (for example, khaki, dull brownish-yellow color) that meets the 8-calorie requirement. The present disclosure allows the end users to have more color options for their clothing and remain cooler on the job since lighter shade fabrics do not absorb as much heat from the sun when working outside.

Arc Flash Definition

An arc flash occurs in an electrical installation whenever there is an insulation failure or short circuit. The short creates an undesired electric discharge that travels through the air between conductors or from a conductor to a ground. The arc flash generates a brilliant flash of light and ionized conductive plasma with temperatures in excess of 9000° F. The thermal energy can set fire to clothing and severely burn human skin even at a significant distance from the event. In fact, fatal burns can occur at distances of over 10 ft. According to Hoagland, Arc flashes are powerful explosions that can have a heat flux exceeding 50-100 cal/cm$^2$/s. Not only is there a thermal hazard when exposed to an arc flash, but protection is also required from the potential additional hazards of molten metal and plasma. Further, Ralph Lee's in "Pressures Developed by Arcs," cites several case histories illustrating the powerful pressure created by arc flash. In one example, an electrician working on a 480 V system is knocked 25 feet when an approximate 100 kA bolted fault occurred. Using Lee's formula, the approximate initial impulse force at 24 inches is calculated at about 260lb/ft$^2$ based on Equation (1).

$$\text{Pounds/ft}^2=(11.5\times\text{kA arc})\div(\text{distance from arc in feet})^{0.9} \qquad \text{Equation (1)}$$

An arc flash is a powerful explosion of force and thermal energy. In the picture a mannequin is placed in front of an electrical panel and an arc flash is created. The explosion is captured in slow motion to show the devastating effect of the flash in terms of the heat and thermal energy produced relative to the mannequin.

Arc Rated Clothing

Protective fabrics and garments for arc flash must be rated and certified to a standard that verifies flame resistance and resistance to arc flash energy. This standard is ASTM F1506, Standard Performance Specification for Flame Resistant Textile Materials for Wearing Apparel for Use by Electrical Workers Exposed to Momentary Electric Arc and Related Thermal Hazards. Under this performance standard, fabrics and garments are tested for flame resistance and arc flash resistance. Labels are included in every garment so that employers may select the appropriate arc resistance for their employees.

OSHA and Industry Standards

OSHA specifies that workers must be protected from harm under the General Duty Clause (29 U.S.C. § 654, 5(a)1). Each employer shall furnish to each of his employees a place of employment which is free from recognized hazards that are causing or are likely to cause death or serious physical harm. Industry associations like the American Society for Testing and Materials or the National Fire Protection Association write industry consensus best practice standards for worker protection. Typically, OSHA will refer to these best practice standards and expect employers to comply with the recommendations. Regarding arc flash, these guideline standards have been developed:

(1) 29 CFR 1910.269 Standard for electric power generation, transmission, and distribution
(2) NFPA 70E: Standard for Electrical Safety in the Workplace,
(3) NESC National Electrical Safety Code
(4) IEEE Guide for Maintenance, Operation, and Safety of Industrial and Commercial Power Systems In each of the aforementioned standards, a hazard risk assessment is performed and the potential arc energy is calculated. The threat is expressed in cal/cm$^2$. Once the hazard is quantified, employers must provide workers flame resistant clothing equal to or greater than the potential hazard. For the majority of electrical work, at least 8 cal/cm$^2$ of protection is needed.

Arc Testing

Arc testing quantifies how much protection an arc rated fabric and garment provides. The arc rating is the value that describes the protective performance of the fabric in an arc exposure. Since most electrical work requires at least 8 cal/cm$^2$, developing fabrics with at least an 8-calorie rating is a major research focus. Although 8 cal/cm$^2$ of protection is required, heavier weight garments are known to be hot and uncomfortable for end users working in hot, humid environments. Consequently, a major focus of arc research is to reduce weight while maintaining an arc rating of at least 8 cal/cm$^2$.

Like the hazard, arc rating is expressed in cal/cm$^2$ and is reported as either Arc Thermal Performance Values (ATPV) or Energy Breakopen Threshold (EBT), whichever is the lower value. ATPV is defined in ASTM F1959/F1959M as the incident energy (cal/cm$^2$) that results in a 50 percent probability that sufficient heat transfers through the tested specimen to cause the onset of a second degree burn injury. EBT is defined in ASTM F1959/F1959M as the incident energy (cal/cm$^2$) on a material that results in a 50 percent probability of fabric breakopen. Breakopen is defined as a hole in the fabric with an area of at least 1.6 cm$^2$. The incidence of a significant hole assumes the onset of a second-degree burn. Consequently, fabrics that break open easily generally receive lower arc ratings.

The first step in solving the problem is to try and understand why the navy fabric performed differently than the khaki. In general, a dark object absorbs more heat than a light fabric. To conduct an arc test, fabric panels are placed over sensors and are then exposed to an arc flash at a predetermined energy level. The sensors behind the panels measure the amount of energy that comes through the fabric panel during the exposure. A calculation is then made to determine if the level of energy recorded would result in a burn.

FIG. 1 show fabric panels after arc exposure. Comparing the navy and khaki fabric, it can be seen that each of navy panels 100 chars across a greater surface area compared to a khaki panel 102. The energy appears to be more evenly distributed across the face of the panel rather than concentrated in a smaller area thereby diluting the energy of the arc flash.

Figure 2:
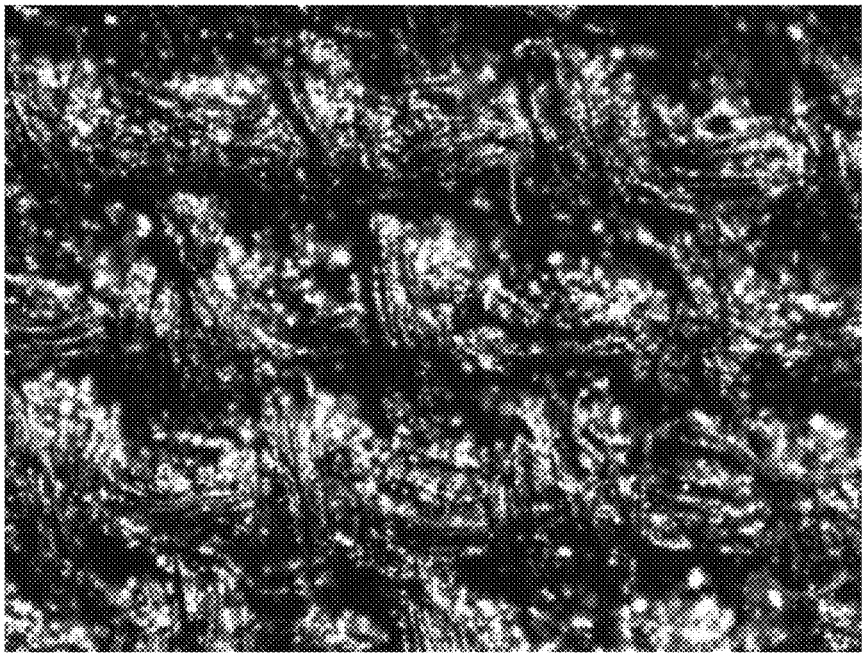
FIG. 2 shows microscopic analysis of a navy fabric.
Figure 3:
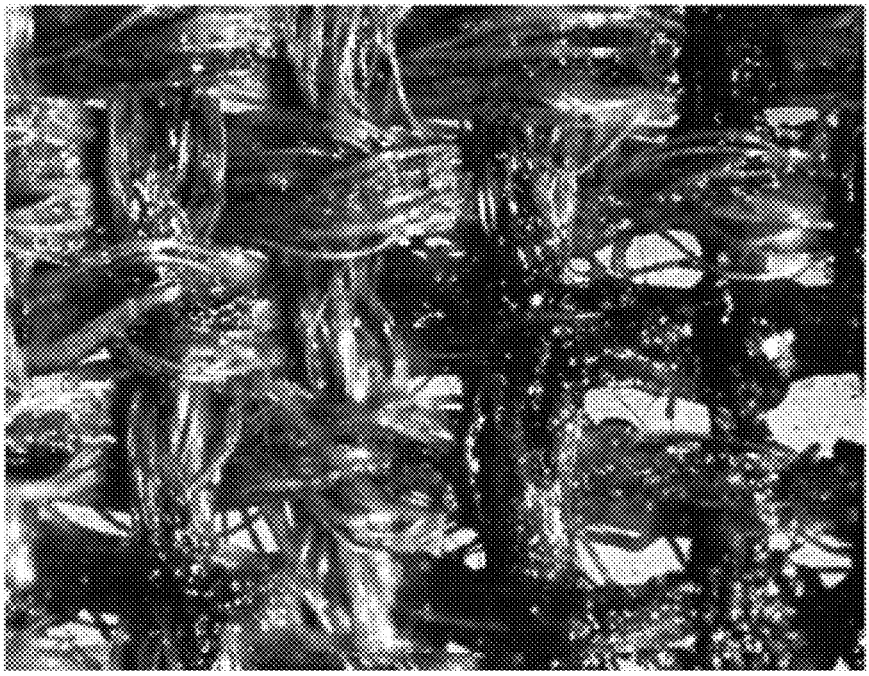
FIG. 3 shows microscopic analysis of a khaki fabric.

Meta-aramid fibers may absorb heat energy during the carbonization process. The fiber swells and thickens in size and seals openings in the fabric helping to eliminate air movement and heat transfer to the interior skin area. As both the fiber and the fabric thicken together this increases the heat barrier and therefore reduces heat transfer to the wearer. FIGS. 2 and 3 show microscopic analyses of the navy fabric and khaki fabric, respectively. When a 4.4 navy fabric (e.g., 4.4 ounce/yr$^2$ navy fabric with a blend of 66% meta aramid, 12% FR Rayon, 12% para aramid, 9% nylon, and 1% anti-static by weight) is hit with a momentary arc flash, the fabric swells and seals shut while the khaki fabric seems to disintegrate and char less. Because the arc energy is diluted across the full panel rather than being concentrated in one spot, the fabric does not disintegrate in one spot and provides better insulation.

The first step in solving the problem is to try and understand why the navy fabric performed differently than khaki fabric. It is theorized that the navy fabric does a better job absorbing heat compared to the khaki fabric. Since the khaki fabric is not able to distribute the energy across the fabric surface heat is concentrated in a smaller surface area. This concentrated energy may create a hole in the fabric. As mentioned previously, the ASTM F1959 Standard Test Method for Determining the Arc Rating of Materials for Clothing classifies any hole larger than 1.6 cm$^2$ a break open in the fabric. Since a break open implies a burn injury, a break open result lowers the protective rating of the fabric. Alternatively, heat energy may also transfer through the fabric if the fabric does not char across a broad surface area. Although a hole may not be formed, the concentrated energy still may travel through the fabric causing a burn. The navy fabric on the other hand has a much larger charred area. Conversely, the heat load in the navy fabric appears to be widely absorbed distributing the heat energy across a much larger surface area. Since the heat energy is diluted across a larger surface area, the fabric evenly absorbs the heat allowing carbonization of the fabric. In this way, a hole in the fabric or transfer of heat energy through the panel is avoided.

A series of fabrics is produced to incorporate energy absorbing fibers into the fabric to try and duplicate the performance of the navy fabric in a lighter shade, khaki. The energy absorbing fibers chosen are OPAN fibers. Although OPAN fibers can absorb a significant amount of heat energy, the fibers are relatively weak compared to Meta and Para aramid fibers as noted in Table 1.

TABLE 1

Comparative Fiber Strength (Basofil Chart)
Fiber Strength

| Fiber | Cn/Tex |
|---|---|
| OPAN | 16-28 |
| Para aramid | 203 |
| Meta aramid | 35-45 |

A fabric may be described in terms of its net blend and/or its yarn blend. A fabric can be made of more than one spun yarns with different fiber blends. Table 2 summarizes the compositions of five different fabric samples. It can be appreciated that fabrics made from a single yarn blend have a net blend equivalent to the weight percentage of fibers in the one yarn. Alternatively, fabrics may be made from more than one yarn and fiber blend. In that case, the net blend is calculated mathematically by taking the weight percentage of each fiber in the blend based upon the fabric construction.

Sample 1 is a control khaki plain woven fabric composed of 66% Meta aramid, 12% flame-resistant (FR) Rayon, 12% Para aramid, and 10% Nylon made from one yarn blend.

Sample 2 is a khaki blend of 66% Meta aramid, 12% FR Rayon, 12% Para aramid, 9% Nylon, and 1% anti-stat (AS) fiber incorporating a dobby weave but no energy absorbing fibers.

Sample 3 incorporates a khaki Warp of 66% Meta aramid, 12% FR Rayon, 12% Para aramid, 9% Nylon, 1% Anti-stat yarns with alternating picks of navy 66% Meta aramid, 12% FR Rayon, 12% Para aramid, 9% Nylon, 1% Anti-stat, 45% OPAN, 35% FR Rayon, 15% Para aramid, and 5% Nylon into a 3/1 twill weave. This yields a net blend of 53% Meta aramid/17% FR Rayon/12% Para aramid/9% OPAN/8% Nylon/1% Antistatic fiber Sample 4 incorporates the same yarns as in Sample 3 into a dobby weave. A khaki Warp of 66% Meta aramid, 12% FR Rayon, 12% Para aramid, 9% Nylon, 1% Anti-stat yarns with alternating picks of navy 66% Meta aramid, 12% FR Rayon, 12% Para aramid, 9% Nylon, 1% Anti-stat, 45% OPAN, 35% FR Rayon, 15% Para aramid, and 5% Nylon into a dobby weave. This yields a net blend of 53% Meta aramid/17% FR Rayon/12% Para aramid/9% OPAN/8% Nylon/1% Antistatic fiber Sample 5 uses the 45% OPAN, % 35 FR Rayon, 15% Para aramid, 5% Nylon exclusively in the fill direction increasing the amount of energy absorbing fiber. This yields a net blend of 39% Meta aramid/22% FR Rayon/18% OPAN/13% Para aramid/7% Nylon/1% Antistatic fiber. The warp yarn for Sample 5 has the same yarn blend as Samples 2-4. A final sample incorporating the yarns from Sample 5 into a dobby weave is made however the fabric is scrapped due to an unacceptable appearance.

TABLE 2

| Sample | Weave | Net Fabric Blend (% by weight) | Ounces/ $yd^2$ | Estimated Arc Result ($cal/cm^2$) |
|---|---|---|---|---|
| 1 | Plain | 66% Meta aramid/12% FR Rayon/ 12% Para aramid/10% Nylon (khaki) | 4.3 | 6.1 |
| 2 | Dobby | 66% Meta aramid/12% FR Rayon/ 12% Para aramid/9% Nylon/1% AS (khaki) | 4.76 | 6.14 |
| 3 | 3/1 LHT | 53% Meta aramid/17% FR Rayon/ 12% Para/9% OPAN/8% Nylon/1% AS (khaki) | 4.74 | 6.17 |
| 4 | Dobby | 53% Meta aramid/17% FR Rayon/ 12% Para/9% OPAN/8% Nylon/1% AS (khaki) | 4.83 | 8.3 |
| 5 | 3/1 LHT | 39% Meta aramid/22% FR Rayon/ 18% OPAN/13% Para aramid/7% Nylon/1% AS (khaki) | 4.74 | 6.7 |

Samples 1 and 2 are made from almost exactly the same blend with Sample 2 weighing slightly more. Sample 1 is a khaki plain woven while Sample 2 is a khaki dobby fabric. Weave design may have a positive impact on arc resistance specifically. In particular, a "dobby weave" may allow for a larger number of air pockets which improves the electrical arc rating and thermal protection of a fabric. Although the Sample 2 fabric incorporates a dobby weave with air pockets, no improvement in arc performance is observed. Samples 3 and 4 both incorporated OPAN energy absorbing fibers in every other pick while Sample 5 incorporates OPAN energy absorbing fibers in every pick. Surprisingly, Sample 4 incorporating a dobby weave and alternating picks of energy absorbing fiber reached the important 8 calorie protection level.

Interestingly neither Sample 4 nor 5 suffers from a break open even though weaker OPAN fibers are used. Further, it is also surprising that Sample 5 which contains more energy absorbing OPAN fibers than Sample 4 performed similar to fabrics in Samples 1 and 2 without the energy absorbing OPAN fibers.

Figure 4:
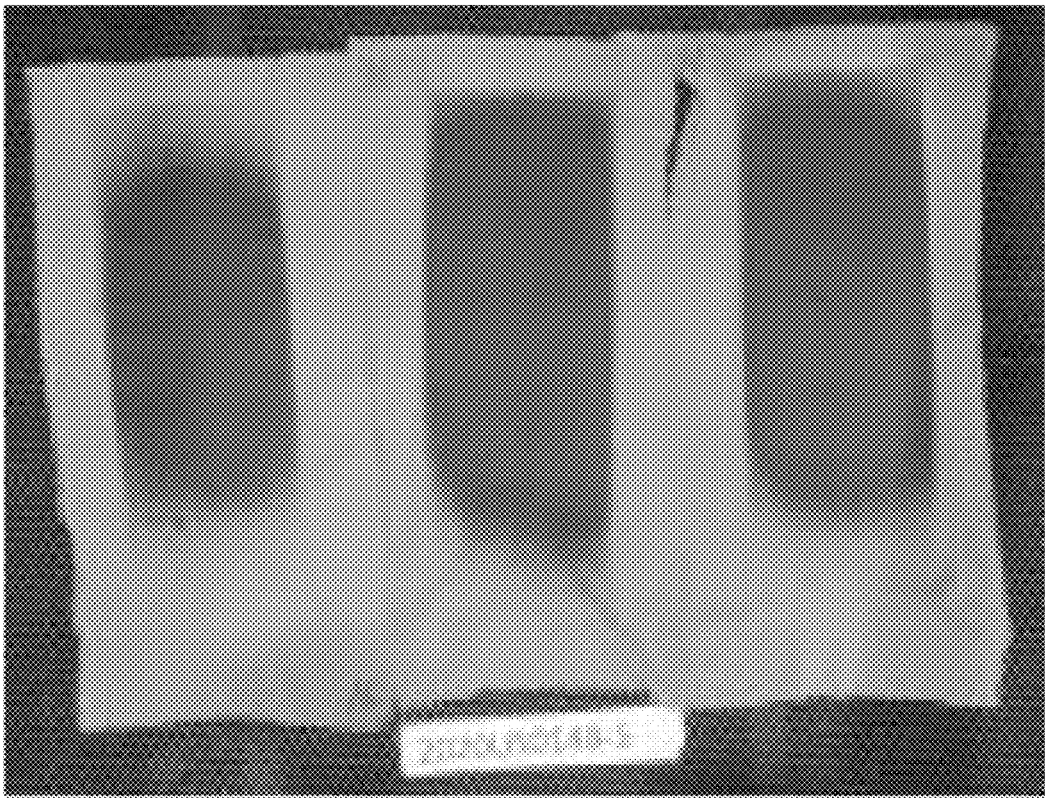
FIG. 4 shows fabric panels of an exemplary fabric after arc flash exposure.

FIG. 4 shows fabric panels from Sample 4 of Table 2 after arc flash exposure. As illustrated in FIG. 4, the charred surface area of each of khaki panels 400 is dramatically increased compared to the earlier version of the khaki panel 102 shown in FIG. 1. This confirms that the fabric disclosed herein is absorbing the arc flash energy over a greater surface area of the fabric effectively diluting the arc flash energy and providing greater insulation and protection. Consequently, the arc flash rating of the fabric is higher in this case rated at 8.3 calories.

Yarns with blends different from the net blend of the fabric are contemplated to modulate the amount of energy absorbing fiber on the surface exposed to the arc. Different weave designs are also contemplated to modulate the amount of energy absorbing fiber on the surface exposed to the arc.

Figure 5:
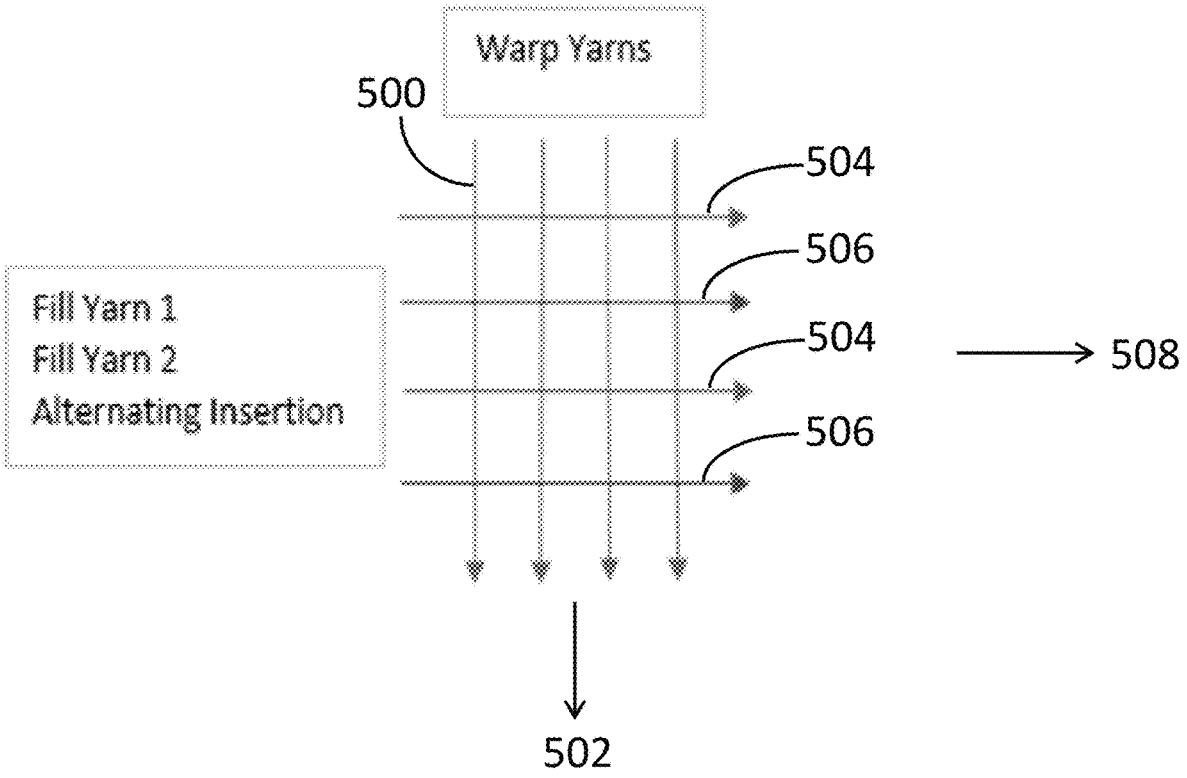
FIG. 5 shows a construction of the yarns of an exemplary fabric.

For example, the fabric of Sample 3 is made of yarns with blends different from the net blend of the fabric. FIG. 5 shows a construction of the yarns of the fabric of Sample 3. Warp yarns 500 are in a first direction 502. A first fill yarn 504 (Fill Yarn 1) and a second fill yarn 506 (Fill Yarn 2) are in alternating insertion in a second direction 508. The first and second fill yarns 504 and 506 are materially different yarns and are arranged substantially parallel to one another. The first direction 502 and the second direction 508 are substantially vertical to each other. In one embodiment, the first fill yarn 504 is navy color, and the second fill yarn 506 is different color (e.g., color other than navy).

Figure 6:
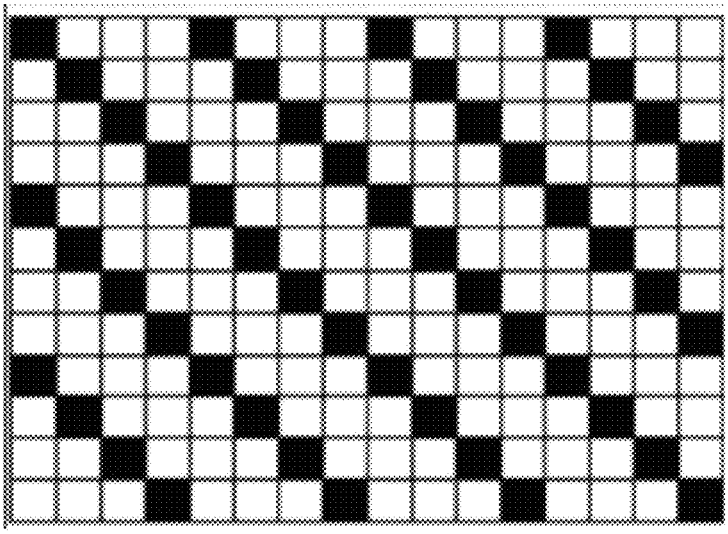
FIG. 6 shows a 3/1 LHT Weave of the fabric of the fabric of FIG. 5.

FIG. 6 shows a weave design (3/1 Left Hand Twill or 3/1 LHT) of the fabric of Sample 3. Table 3 shows blend calculations for varying warp and fill fiber blends that arrives at the effective fabric blend of Sample 3 shown in Table 2.

TABLE 3

Blend Calculation for Varying Warp and Fill Fiber Blends

| Fibers | Warp Yarn Blend 60.60% 0% | % in Fabric Adj. % 0.0% | Fibers | Fill Yarn Blend 1 19.7% 0% | % in Fabric Adj. % 0.0% | Fill Yarn Blend 2 19.7% 0% | % in Fabric Adj. % 0.0% | % in Fabric Total Actual % 0.0% | Fibers | Declared Blend |
|---|---|---|---|---|---|---|---|---|---|---|
| FR Rayon | 12% | 7.3% | FR Rayon | 12% | 2.4% | 35% | 6.9% | 16.6% | FR Rayon | 17% |
| | 0% | 0.0% | | 0% | 0.0% | 0% | 0.0% | 0.0% | | |
| | 0% | 0.0% | OPAN | 0% | 0.0% | 45% | 8.9% | 8.9% | OPAN | 9% |

TABLE 3-continued

| Blend Calculation for Varying Warp and Fill Fiber Blends | | | | | | | | | | |
|---|---|---|---|---|---|---|---|---|---|---|
| Fibers | Warp Yarn Blend 60.60% 0% | % in Fabric Adj. % 0.0% | Fibers | Fill Yarn Blend 1 19.7% 0% | % in Fabric Adj. % 0.0% | Fill Yarn Blend 2 19.7% 0% | % in Fabric Adj. % 0.0% | % in Fabric Total Actual % 0.0% | Fibers | Declared Blend |
| Para | 12% | 7.3% | Para | 12% | 2.4% | 15% | 3.0% | 12.6% | Para-Aramid | 12% |
| Nylon | 9% | 5.5% | Nylon | 9% | 1.8% | 5% | 1.0% | 8.2% | Nylon | 8% |
| AS | 1% | 0.6% | AS | 1% | 0.2% | 0% | 0.0% | 0.8% | Anti-Stat | 1% |
| Meta KH | 66% | 40.0% | Meta NB | 66% | 13.0% | 0% | 0.0% | 53.0% | Meta-Aramid | 53% |
| | 100% | 60.6% | | 100% | 19.7% | 100% | 19.7% | 100% | | 100% |
| | Pure Fiber Only | | | Pure Fiber Only | | | | | | |

Figure 7:
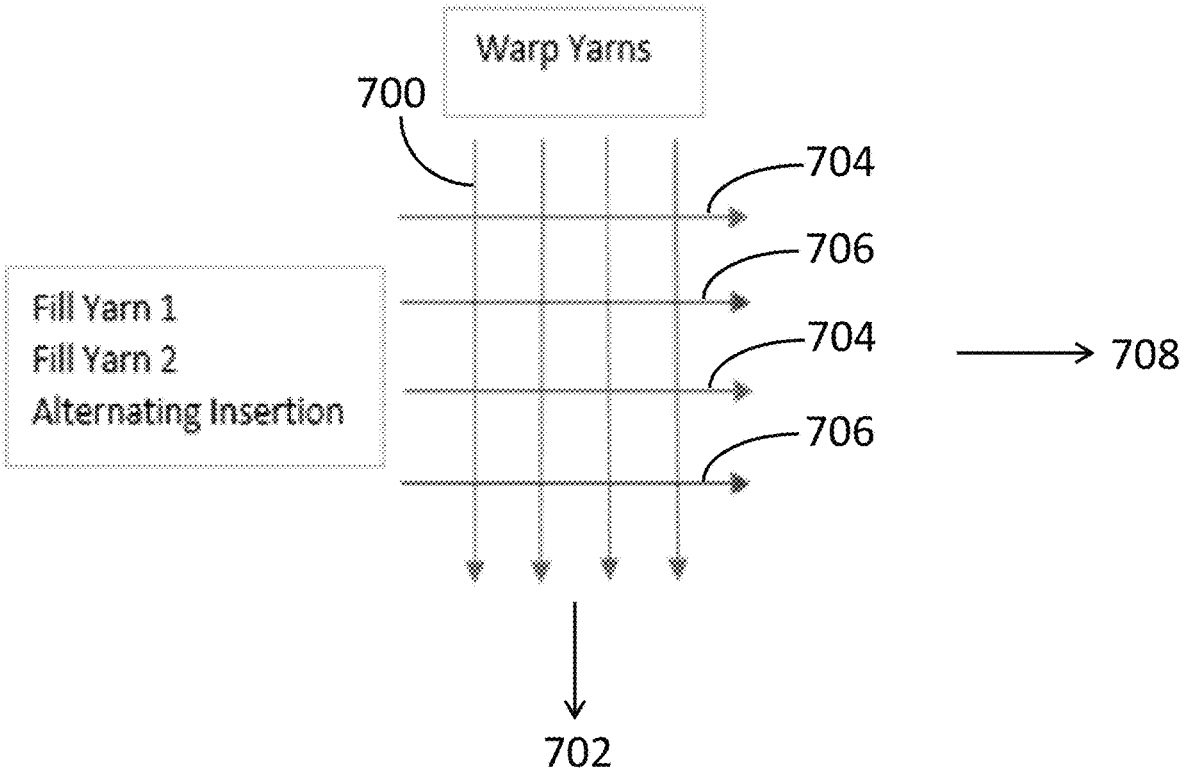
FIG. 7 shows a construction of the yarns of another exemplary fabric.

The fabric of Sample 4 is made of yarns with blends different from the net blend of the fabric. FIG. 7 shows a construction of the yarns of the fabric of Sample 4. Warp yarns 700 are in a first direction 702. A first fill yarn 704 (Fill Yarn 1) and a second fill yarn 706 (Fill Yarn 2) are in alternating insertion in a second direction 708. The first and second fill yarns 704 and 706 are materially different yarns and are arranged substantially parallel to one another. The first direction 702 and the second direction 708 are substantially vertical to each other. In one embodiment, the first fill yarn 704 is navy color, and the second fill yarn 706 is different color (e.g., color other than navy).

Figure 8:
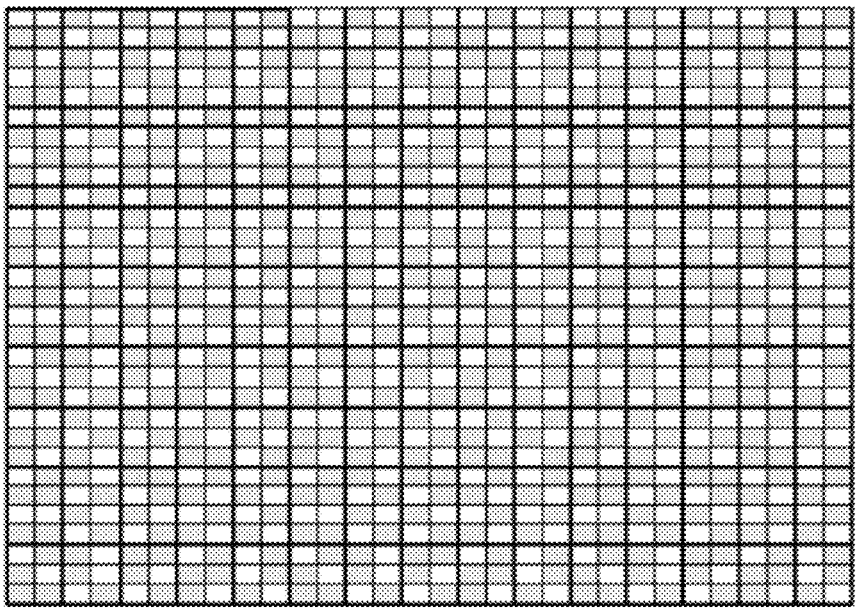
FIG. 8 shows a Dobby weave (Helix Diamond Weave) of the exemplary fabric of FIG. 7.

FIG. 8 shows a weave design (Dobby Weave or Helix Diamond Weave) of the fabric of Sample 4. Table 4 shows blend calculations for varying warp and fill fiber blends that arrives at the effective fabric blend of Sample 4 shown in Table 2.

TABLE 4

| Blend Calculated for Varying Warp and Fill Fiber Blends | | | | | | | | | | |
|---|---|---|---|---|---|---|---|---|---|---|
| Fibers | Warp Yarn Blend 61% 0% | % in Fabric Adj. % 0.0% | Fibers | Fill Yarn Blend 1 19.5% 0% | % in Fabric Adj. % 0.0% | Fill Yarn Blend 2 19.5% 0% | % in Fabric Adj.% 0.0% | % in Fabric Total Actual % 0.0% | Fibers | Declared Blend |
| FR Rayon | 12% | 7.3% | FR Rayon | 12% | 2.3% | 35% | 6.8% | 16.4% | FR Rayon | 17% |
| | 0% | 0.0% | | 0% | 0.0% | 0% | 0.0% | 0.0% | | |
| | 0% | 0.0% | OPAN | 0% | 0.0% | 45% | 8.8% | 8.8% | OPAN | 9% |
| Para | 12% | 7.3% | Para | 12% | 2.3% | 15% | 2.9% | 12.5% | Para-Aramid | 12% |
| Nylon | 9% | 5.4% | Nylon | 9% | 1.8% | 5% | 1.0% | 8.2% | Nylon | 8% |
| AS | 1% | 0.6% | AS | 1% | 0.2% | 0% | 0.0% | 0.8% | Anti-Stat | 1% |
| Meta-KH | 66% | 39.9% | Meta-NB | 66% | 12.9% | 0% | 0.0% | 52.8% | Meta-Aramid | 53% |
| | 100% | 61% | | 100% | 19.5% | 100% | 19.5% | 100% | | 100% |
| | Pure Fiber Only | | | Pure Fiber Only | | | | | | |

In Sample 4, the warp yarns are about 60-61% by weight based on the total weight of the fabric and the warp yarns include: flame resistant rayon, about 12% by weight, based on the total weight of the warp yarns; para-aramid, about 12% by weight, based on the total weight of the warp yarns; nylon fiber, about 9% by weight, based on the total weight of the warp yarns; anti-static fiber, about 1% by weight, based on the total weight of the warp yarns; and meta-aramid fiber, about 66% by weight, based on the total weight of the warp yarns. The first fill yarn are about 19-20 by weight based on the total weight of the fabric and the first fill yarns include: flame resistant Rayon, about 12% by weight, based on the total weight of the first fill yarns; para-aramid, about 12% by weight, based on the total weight of the first fill yarns; nylon fiber, about 9% by weight, based on the total weight of the first fill yarns; anti-static fiber, about 1% by weight, based on the total weight of the first fill yarns; and meta-aramid fiber, about 66% by weight, based on the total weight of the first fill yarns. The second fill yarns are about 19-20% by weight based on the total weight of the fabric and the second fill yarns include: flame resistant Rayon, about 35% by weight, based on the total weight of the second fill yarns; oxidized polyacrylonitrile fiber, about 45% by weight, based on the total weight of the second fill yarns; para-aramid, about 15% by weight, based on the total weight of the second fill yarns; and nylon fiber, about 5% by weight, based on the total weight of the second fill yarns.

The fabric of Sample 4 may be a light color. The fabric of Sample 4 may be a khaki color. The fabric of Sample 4 may be any color other than navy.

Figure 9:
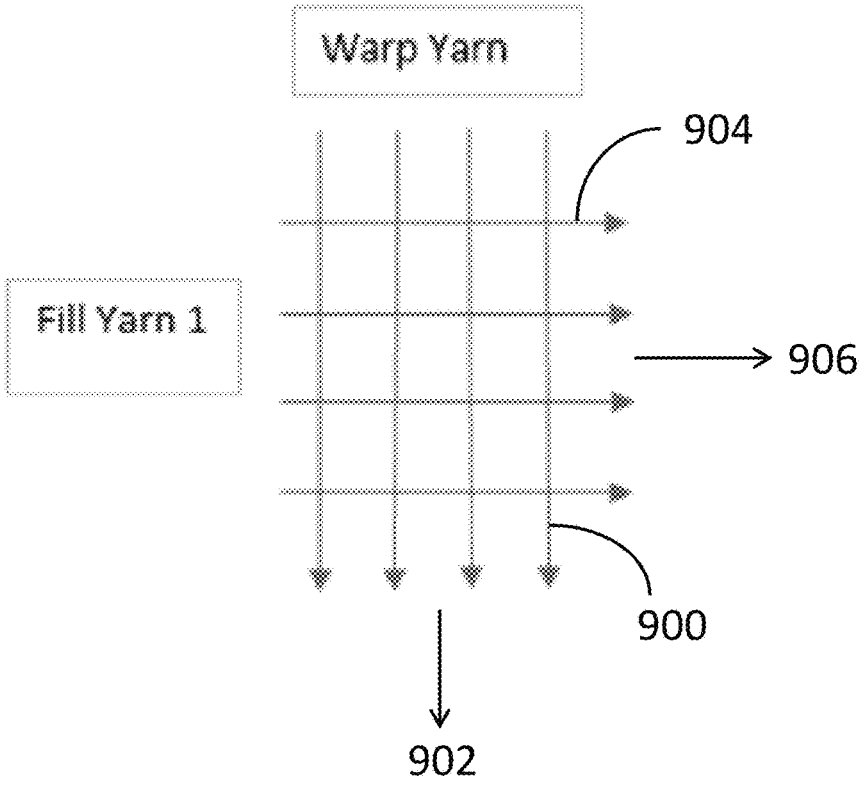
FIG. 9 shows a construction of the yarns of another exemplary fabric.

The fabric of Sample 5 is made of yarns with blends different from the net blend of the fabric. FIG. 9 shows a construction of the yarns of the fabric of Sample 5. Warp yarns 900 are in a first direction 902. Fill yarns 904 (Fill Yarn 1) are in second direction 906, which is substantially vertical to the first direction 902.

Figure 10:
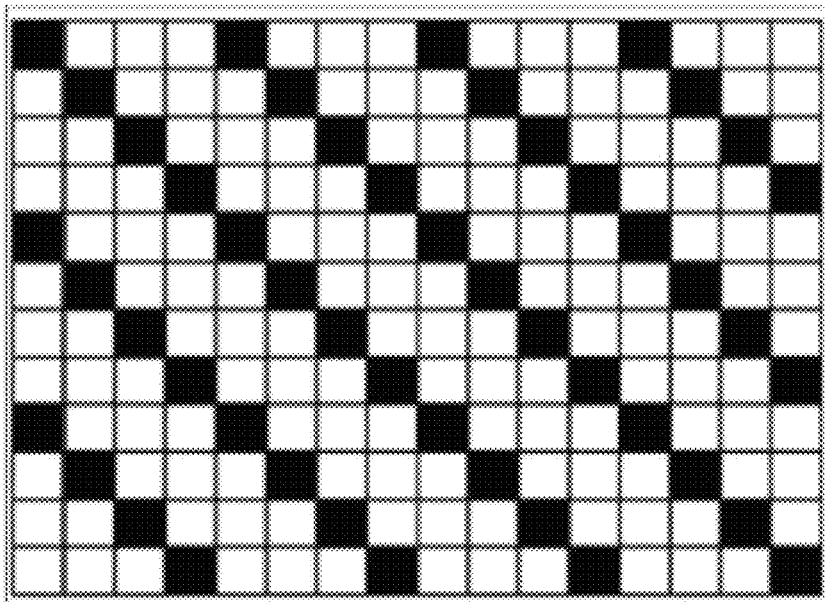
FIG. 10 shows a 3/1 LHT of the fabric of FIG. 9.

FIG. 10 shows a weave design (3/1 Left Hand Twill or 3/1 LHT) of the fabric of Sample 5. Table 5 shows blend calculations for varying warp and fill fiber blends that arrives at the effective fabric blend of Sample 5 shown in Table 2.

TABLE 5

Blend Calculation for Varying Warp and Fill Fiber Blends

| Fibers | Warp Yarn Blend 59% 0% | % in Fabric Adj. % 0.0% | Fibers | Fill Yarn Blend 1 41% 0% | % in Fabric Adj. % 0.0% | % in Fabric Total Actual % 0.0% | Fibers | Declared Blend |
|---|---|---|---|---|---|---|---|---|
| FR Rayon | 12% | 7.1% | FR Rayon | 35% | 14.4% | 21.5% | FR Rayon | 22% |
| | 0% | 0.0% | | 0% | 0.0% | 0.0% | | |
| | 0% | 0.0% | OPAN | 45% | 18.6% | 18.6% | OPAN | 18% |
| Para | 12% | 7.1% | Para | 15% | 6.2% | 13.2% | Para-Aramid | 13% |
| Nylon | 9% | 5.3% | Nylon | 5% | 2.1% | 7.4% | Nylon | 7% |
| AS | 1% | 0.6% | AS | 0% | 0.0% | 0.6% | Anti-Stat | 1% |
| Meta KH | 66% | 38.8% | Meta NB | 0% | 0.0% | 38.8% | Meta-Aramid | 39% |
| | 100% | 59% | | 100% | 41% | 100.0% | | 100% |
| | Pure Fiber Only | | | Pure Fiber Only | | | | |

The fabrics of Samples 1-5 may be a light color. The fabrics of Samples 1-5 may be a khaki color. The fabrics of Samples 1-5 may be any color other than navy.

In Tables 3, 4, and 5 and FIGS. 6, 8 and 10 the direction of the warp yarns and the direction of the fill yarns are substantially vertical to one another.

As used herein, the term "intimately blended," when used in conjunction with a yarn, refers to a statistically random mixture of the staple fiber components in the yarn.

The flame-resistant (FR) Rayon fiber may be hydrophilic. FR Rayon fiber is sold under the Lenzing FR name, from Lenzing Group, Austria.

As used herein, the term "nylon fiber" refers to a fiber consisting essentially of a polyamide synthetic polymer. Polyamide is a thermoplastic having high abrasion resistance and toughness. Addition of nylon fiber to the fiber blend may increase abrasion resistance of a fabric.

As used herein, the term "aramid fiber" refers to a manufactured fiber in which the fiber-forming substance is a long-chain synthetic polyamide in which at least 85% of the amide linkages, (—CO—NH—), are attached directly to two aromatic rings, including, but not limited to, para-aramid (p-aramid) and meta-aramid (m-aramid). Aramid fiber is a strong, heat-resistant fiber formed of polymers with repeating aromatic groups branching from a carbon backbone, used in materials for bulletproof vests and radial tires. Examples of para-aramids include, but are not limited to, poly(p-phenylene terephthalamide) (available from KEVLAR® DuPont de Nemours and Company), TWARON® (available from Teijin Twaron BV headquartered in Arnhem, the Netherlands), and TECHNORA (an aramid that is useful for a variety of applications that required high strength or chemical resistance; available from the company Teijin Aramid). KEVLAR is a para-aramid fiber having a very high tenacity of between 28 and 32 grams/denier and outstanding heat resistance.

Examples of meta-aramids include, but are not limited to, poly(m-phenylene isophthalamide), such as NOMEX® (available from E.I. du Pont de Nemours and Company) and CONEX® (available from Teijin Twaron BV). Unlike Kevlar, Nomex cannot align during filament formation and is typically not as strong as para-aramid or KEVLAR. Meta-aramid, however, has excellent thermal, chemical, and radiation resistance. Aramid fibers feature excellent thermal stability and are highly non-flammable. These fibers have a very high resistance to heat and are resistant to melting, dripping and burning at a temperature of at least 700° F. Moreover, their Limiting Oxygen Index (LOI) value is preferably in the range of between about 28 and about 30. The LOI represents the minimum $O_2$ concentration of an $O_2/N_2$ mix required to sustain combustion of a material. The LOI is determined by the ASTM Test D 2862-77. Meta-aramids and para-aramids are inherently hydrophobic but in some cases may be treated to render them hydrophilic, at least temporarily.

Most aramid fibers are not dye accepting and, when incorporated into a fiber blend in a high concentration, can significantly limit the color ranges possible for a fabric. However, some aramid fibers are printable, or dye accepting. For example, a low-crystallized type meta-aramid fiber, such as NOMEX® 462 (available from E.I. du Pont de Nemours and Company), is a printable meta-aramid. In addition, some meta-aramid fibers are available as producer-colored meta-aramids, wherein fibers are colored during manufacturing of the fibers.

As used herein, the term "anti-static fiber" or conductive refers to a fiber that, when incorporated into a fabric or other material, eliminates or reduces static electricity. Suitable fibers include, but are not limited to, metal fibers (steel, copper or other metal), metal-plated polymeric fibers, and polymeric fibers incorporating carbon black on the surface and/or in the interior of the fiber, such as those described in U.S. Pat. Nos. 3,803,453, 4,035,441, 4,107,129, and the like. Anti-static carbon fiber is a preferred anti-static fiber. One example of a conductive fiber is NEGASTAT® (available from E.I. du Pont de Nemours and Company), a carbon fiber comprising a carbon core of conductive carbon surrounded by a non-conductive polymer cover, either nylon or polyester. INVISTA No-Shock® anti-static fiber is another example. By way of example, a steel wire is available under the names BEKINOX and BEKITEX from Bekaert S. A. in a diameter as small as 0.035 millimeter. Another anti-static fiber is the product X-static made by Noble Fiber Technologies, a nylon fiber coated with a metal (silver) layer. The X-static fibers may be blended with other fibers, such as meta-aramid, in the process of yarn spinning.

As used herein, the term "hydrophilic," as it refers to a fabric, means that the fabric has a horizontal wicking of less than about twenty seconds. A yarn or blend of yarns may be considered hydrophilic when a fabric made exclusively therefrom has a horizontal wicking time of less than about ten seconds and more preferably less than five seconds based upon the AATCC 79 Test Method for horizontal wicking. In an exemplary embodiment, the hydrophilic fiber component consists essentially of hydrophilic fiber selected from the group consisting of selected from cellulosic fibers, wool, and combination thereof. In an exemplary embodiment, the hydrophilic fiber consists essentially of cellulosic fibers, wool, FR acrylic derivative fiber and combinations thereof.

As used herein, the term "basis weight" refers to a measure of the weight of a fabric per unit area. Typical units include ounces per square yard and grams per square centimeter.

As used herein, the term "substantially vertical" refers to equal to or very close to a 90 degree angle, e.g., 90 degrees, 90 degrees±1 degree, 90 degrees±2 degrees, 90 degrees±3 degrees, 90 degrees±4 degrees, 90 degrees±5 degrees.

As used herein, the term "substantially parallel" refers to equal to or very close to a 180 degree angle, e.g., 180 degrees, 180 degrees±1 degree, 180 degrees±2 degrees, 180 degrees±3 degrees, 180 degrees±4 degrees, 180 degrees±5 degrees.

The invention claimed is:

1. A fabric, comprising:

flame-resistant Rayon fiber, about 10% by weight to about 20% by weight, based on an effective fabric blend;

oxidized polyacrylonitrile fiber, about 5% by weight to about 15% by weight, based on the effective fabric blend;

para-aramid, about 5% by weight to about 15% by weight, based on the effective fabric blend;

nylon fiber, greater than about 0% by weight to about 15% by weight, based on the effective fabric blend;

anti-static fiber, less than 2% by weight, based on the effective fabric blend; and meta-aramid fiber, about 44% by weight to about 80% by weight, based on the effective fabric blend, wherein the fabric has a basis weight of less than about 6.5 oz/yd$^2$ or 220.39 g/m$^2$.

2. The fabric of claim 1, wherein the fabric has an arc rating of at least 8 cal/cm$^2$.

3. The fabric of claim 1, wherein the fabric is a color other than navy.

4. The fabric of claim 1, wherein the spun yarns comprise:

warp yarns in a first direction;

a first fill yarns in a second direction;

a second fill yarns in the second direction, wherein the first fill yarns and the second fill yarns are in alternating insertion and the first direction is substantially vertical to the second direction.

5. The fabric of claim 4, where the fabric comprises dobby diamond weave.

6. The fabric of claim 4, wherein the warp yarns are about 60-61% by weight based on the total weight of the fabric and the warp yarns comprise:

flame resistant rayon, about 12% by weight, based on the total weight of the warp yarns;

para-aramid, about 12% by weight, based on the total weight of the warp yarns;

nylon fiber, about 9% by weight, based on the total weight of the warp yarns;

anti-static fiber, about 1% by weight, based on the total weight of the warp yarns; and meta-aramid fiber, about 66% by weight, based on the total weight of the warp yarns, wherein the first fill yarn are about 19-20 by weight based on the total weight of the fabric and the first fill yarns comprise:

flame resistant Rayon, about 12% by weight, based on the total weight of the first fill yarns;

para-aramid, about 12% by weight, based on the total weight of the first fill yarns;

nylon fiber, about 9% by weight, based on the total weight of the first fill yarns;

anti-static fiber, about 1% by weight, based on the total weight of the first fill yarns; and meta-aramid fiber, about 66% by weight, based on the total weight of the first fill yarns, wherein the second fill yarns are about 19-20% by weight based on the total weight of the fabric and the second fill yarns comprise:

flame resistant Rayon, about 35% by weight, based on the total weight of the second fill yarns;

oxidized polyacrylonitrile fiber, about 45% by weight, based on the total weight of the second fill yarns;

para-aramid, about 15% by weight, based on the total weight of the second fill yarns; and nylon fiber, about 5% by weight, based on the total weight of the second fill yarns.

7. The fabric of claim 4, wherein the first fill yarns are navy color.

8. The fabric of claim 1, where in the flame resistant Rayon is hydrophilic.

9. The fabric of claim 1, wherein the fabric is a khaki color.

* * * * *